United States Patent [19]

Jones

[11] Patent Number: 4,558,481

[45] Date of Patent: Dec. 17, 1985

[54] JOINT GROUTING TOOL

[76] Inventor: David J. Jones, 27 Pant-Y-fid Roo, Aberbargoed, Glamorgan, Great Britain

[21] Appl. No.: 586,359

[22] Filed: Mar. 5, 1984

[30] Foreign Application Priority Data

Mar. 5, 1983 [GB] United Kingdom ..... 8306128

[51] Int. Cl.[4] ..... E04G 21/20

[52] U.S. Cl. ..... 15/105.5; 15/235.3; 425/183; 425/458

[58] Field of Search ..... 425/458, 183; 15/235.3, 15/105.5, 236 R, 236 A

[56] References Cited

U.S. PATENT DOCUMENTS

| | | | |
|---|---|---|---|
| 338,029 | 3/1886 | Bright | 425/458 |
| 1,292,558 | 1/1919 | Ackerson | 15/235.3 |
| 1,354,443 | 9/1920 | Wright | 15/235.3 |
| 1,511,807 | 10/1924 | Garner et al. | 15/105.5 |
| 1,764,106 | 6/1930 | Kaufman | 15/105.5 |
| 2,602,232 | 7/1952 | Keast | 15/235.3 |
| 3,237,235 | 3/1966 | Moody | 15/235.3 |

*Primary Examiner*—Jay H. Woo
*Assistant Examiner*—James C. Housel
*Attorney, Agent, or Firm*—Young & Thompson

[57] ABSTRACT

A joint grouting tool has a mounting body (2) carried at the end of a handle (1), and incorporating a cavity which receives a grouting iron (9). The grouting iron (9) is fixed in place by a captive bolt (10). The tool is rolled over brickwork on wheels (4) carried on a shaft (3) so that the projecting portion of the grouting iron (9) enters a joint to compress and smooth grouting material therein. Excess material in the joint can be raked out as a preliminary step by using the tool in an inverted position so that the tip (14) of a raking tool (12) enters the joint in the brickwork.

4 Claims, 10 Drawing Figures

JOINT GROUTING TOOL

The present invention relates to a tool for grouting joints in brickwork, blockwork or paving or the like (all of which will be termed brickwork, for convenience, hereafter). If a joint in brickwork filled with mortar or the like is merely scraped, such as with a trowel, to a generally required depth, it is difficult to achieve an even surface and a constant depth to the grout in the joint. Unless the grouting material is pressed home firmly, a porous joint is left, in which rainwater can penetrate, thus leading to deterioration of the joint.

It is the object of this invention to provide a grouting tool which will enable a joint to be grouted in firm manner and to a required depth.

According to this invention there is provided a joint grouting tool for grouting joints in brickwork and comprising a handle providing at one end a mounting on which is fitted a removable jointing iron, the mounting also supporting a guide member which locates the tool on the surface of the brickwork incorporating the joint and determines the depth of penetration of the jointing iron into the joint. Whilst the term "grouting iron" is used herein it will be appreciated that it need not necessarily be constructed from iron but could be made from other hard-wearing metals or even hard-wearing plastics materials.

When such a tool is pushed over the surface of the brickwork incorporating the joint the jointing iron will press the grouting material home firmly and also create a joint of generally constant depth.

The handle in the tool is ideally a bar projecting at an angle from the mounting. The guide member could be a pair of skids or slides positioned on two sides of the mounting, but it is preferred that the guide member should be a pair of wheels or roller or barrel bearings mounted on a shaft passing through the mounting. In this case, the grouting iron will ideally be shaped with a curved working face having a centre of curvature on the axis of the shaft.

The grouting iron may be screw-threadedly engaged with the mounting. Ideally the grouting iron is received partially in a cavity defined in the body of the mounting. Advantageously, the grouting iron is one of a set which can be used to create a variety of grouting effects. Ideally, the mounting provides for two grouting irons simultaneously, one of which may be a raking tool for initial raking away of surplus grouting material. A preferred arrangement is one enabling the two grouting irons to be attached to upper and lower surfaces of the mounting, with the guide member being positioned such that the tool can be used in normal or inverted attitudes so that the one or the other of the grouting irons will act on the joint.

The invention may be performed in various ways and a preferred embodiment thereof will now be described, with reference to the accompanying drawings, in which.

Figure 1:
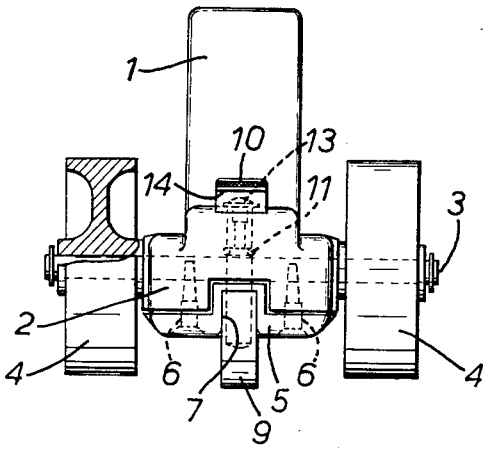
FIG. 1 is a front view of a grouting tool of this invention.
Figure 2:
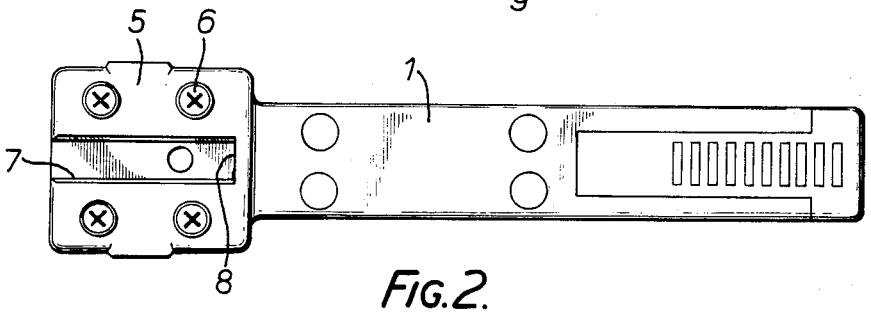
FIG. 2 is an underneath plan view of the mounting and handle portions of the tool shown in FIG. 1.
Figure 3:
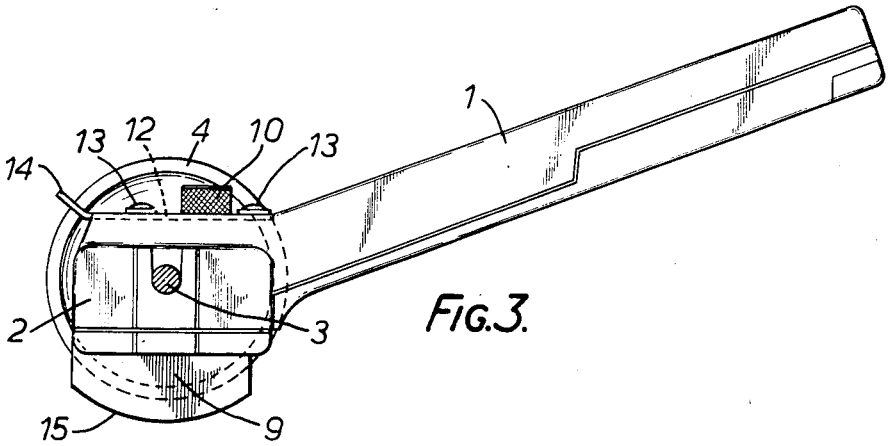
FIG. 3 is a side view of the tool shown in FIG. 1.

Referring firstly to FIGS. 1 to 3 of the drawings the joint grouting tool shown there comprises a handle 1 extending from a mounting 2 incorporating a shaft 3 which carries a pair of wheels 4. These wheels could, if desired, be replaced by roller or barrel bearings. A base portion 5 of the mounting is fixed to the main body with screws 6 and incorporates a cavity 7 having a rear stop 8. Received within the cavity 7 is a grouting iron 9. This is releasably held in place by a bolt 10 held captive within the mounting body 2 by a circlip 11. On the upper face of the mounting body 2 there is fitted a raking iron 12 which is held in place by a pair of screws 13. As shown in FIG. 3 the tip 14 of the raking iron 12 is turned up and away from the mounting body 2.

In use the grouting tool is first laid against brickwork incorporating joints so that the tip 14 of the raking tool 12 enters one of the joints and the tool can then be drawn over the brickwork so that excess material is scraped out of the joint. The grouting tool is then turned over so that the grouting iron 9 enters the joint and the tool is again run over the brickwork so that the grouting iron smooths and firms the grouting material within the joint.

Figure 4:
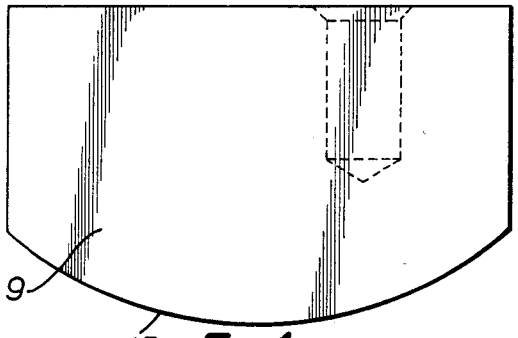
FIG. 4 is a side view of a grouting iron used with the tool of FIG. 1.

The basic shape of the grouting iron 9 is shown in FIG. 4. In particular it has a curved lower face 15 which, when the grouting iron is attached to the mounting body 2, has a centre of curvature on the axis of the shaft 3 so that, as the tool is run over the brickwork, the attitude of the tool will not alter the extent to which the grouting iron 9 enters the joint which is determined solely by the difference in radius between the concentric surfaces of the wheels 4 and the surface 15 of the grouting iron 9.

Figure 5:
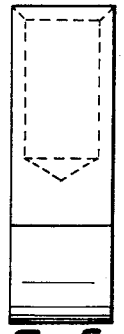
FIGS. 5 to 9 are end views of various possible shapes for the grouting iron of FIG. 4.
Figure 6:
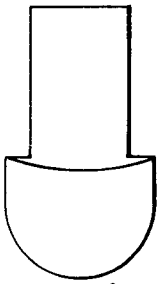
Figure 7:
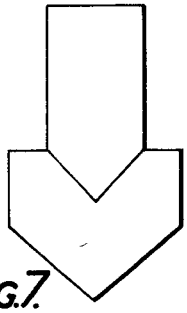
Figure 8:
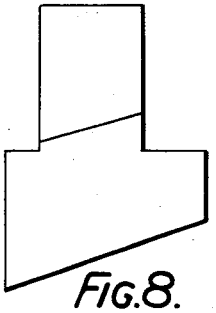
Figure 9:
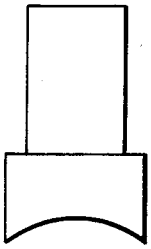
Figure 10:
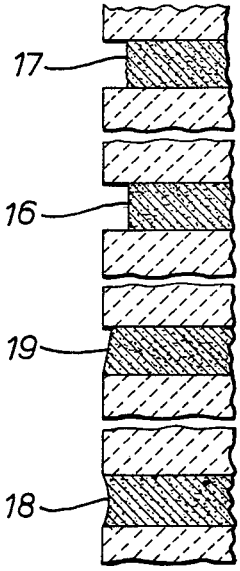
FIG. 10 is a section through a wall illustrating various grouting effects which may be achieved using the grouting tool of this invention.

FIG. 5 illustrates a square ended grouting iron which will therefore create a recessed joint of the form as illustrated at 16 in FIG. 10 (the joint 17 shown in FIG. 10 illustrates the effect of roughly scraping out the joint with the raking took 12). A grouting iron having a curved end as shown in FIG. 6 will create a joint of the type as illustrated at 18 in FIG. 10. A V-shaped joint could be formed using the grouting iron shown in FIG. 7. FIG. 8 illustrates a grouting tool 9 having an angled lower face which would create a joint of the type as shown at 19 in FIG. 10. Finally, FIG. 9 illustrates a grouting iron having a convex curved lower face which will form a "bucket handle joint".

Of course when providing a set of grouting irons for use with the grouting tool they could be made to have various depths so as to be able to form joints in brickwork to any desired depth. Alternatively spacer shims could be inserted into the cavity 7 to increase the extent to which the grouting iron 9 projects from the mounting body 2 after it has been secured tightly by rotating the bolt 10. Whilst a grouting iron having a curved lower surface 15 as shown in FIG. 4 is much preferred, for certain requirements a grouting iron having a straight lower surface may be preferred. This would be the case particularly if the wheels 4 were replaced by simple skids or slides whose lower faces would lie parallel with the lower face of the grouting iron.

It will be appreciated that other methods of interconnecting the various parts forming the joint grouting tool may be employed as may occur to those skilled in the art but the method shown in the drawings is preferred for simplicity and security of the parts being interconnected.

I claim

1. A joint grouting tool for grouting joints in brickwork and comprising a mounting body having an upper and a lower surface, a handle provided at one end of the mounting body and projecting upwardly at an angle from the body, a removable grouting iron fitted to project downwardly below the lower surface of the mounting body, a guide member comprising a pair of wheels mounted on a shaft passing through the mounting body for location of the tool on the surface of the brickwork incorporating the joint and determining the depth of penetration of the grouting iron into the joint, the grouting iron being shaped with a curved working face having a center of curvature on the axis of the shaft, and wherein the upper surface of the mounting provides for attachment of a raking tool having a raking portion projecting beyond the circumference of the wheels and in a direction away from the handle but upwardly at an angle comparable to that of the handle, so that when the tool is placed in an inverted attitude the raking tool can be moved through joints between the brickwork, as the wheels run over the surface of the brickwork, to perform a preliminary raking action.

2. A tool according to claim 1, wherein the grouting iron is screw-threadedly engaged with the mounting body.

3. A tool according to claim 1, wherein a cavity is defined in the mounting body and the grouting iron is received partially in said cavity.

4. A tool according to claim 1, wherein the grouting iron is one of a set which can be used to create a variety of grouting effects.

* * * * *